United States Patent [19]

Hill

[11] Patent Number: 4,584,810

[45] Date of Patent: Apr. 29, 1986

[54] METAL SPACE TRUSS

[76] Inventor: Arne Hill, Malmgårdsvägen 32, S-116 38 Stockholm, Sweden

[21] Appl. No.: 615,556

[22] Filed: May 31, 1984

[30] Foreign Application Priority Data

Jun. 14, 1983 [SE] Sweden ..... 8303369

[51] Int. Cl.[4] ..... E04N 12/00

[52] U.S. Cl. ..... 52/648; 52/650; 403/172; 403/176

[58] Field of Search ..... 52/648, 650, DIG. 10, 52/655; 403/170–172, 176, 271, 272

[56] References Cited

U.S. PATENT DOCUMENTS

| | | | |
|---|---|---|---|
| 490,267 | 1/1893 | Burnham et al. | 52/655 |
| 3,994,111 | 11/1976 | Papayoti | 52/650 |

FOREIGN PATENT DOCUMENTS

| | | | |
|---|---|---|---|
| 340163 | 7/1920 | Fed. Rep. of Germany | 403/272 |
| 1227064 | 9/1961 | France | 52/648 |
| 2229831 | 12/1974 | France . | |
| 652773 | 2/1963 | Italy | 52/648 |
| 1596019 | 8/1981 | United Kingdom . | |
| 1331691 | 10/1972 | U.S.S.R. | 52/648 |

*Primary Examiner*—Henry E. Raduazo
*Assistant Examiner*—John Malcolm White
*Attorney, Agent, or Firm*—Fred Philpitt

[57] ABSTRACT

A metal space truss comprises two generally horizontally extending and vertically spaced lattices, an upper one composed of two intersecting groups of parallel steel T-bars having downwardly directed webs with generally vertically oriented side faces forming one or more inner corners in each node, and a lower one composed of two intersecting groups of parallel steel bars also having cross sections presenting generally vertically oriented side faces forming in each node one or more inner corners being unobstructed in a direction towards said upper lattice. The two lattices are interconnected by a plurality of struts, each of which has a generally trough-shaped cross section and extends from a first node in said upper lattice to a second node in said lower lattice in a manner to form an oblique angle with the respective planes of the two lattices and also an oblique angle to the bars thereof. The respective end portions of each such strut are specially designed to be secured to said first and second nodes, respectively, by means of double bolt connections while being received in related inner corners of the nodes.

9 Claims, 13 Drawing Figures

METAL SPACE TRUSS

BACKGROUND OF THE INVENTION

1. Field of the Invention

The present invention relates to metal space trusses of the kind comprising two at least generally horizontally extending and vertically spaced lattices, an upper one and a lower one, which are both composed of two intersecting groups of mutually parallel bars which in the respective lattices are joined to each other in a plurality of nodes, and a plurality of struts, each of which forms an oblique angle with the planes of the two lattices and connects a node in the upper lattice to a node in the lower lattice.

2. Description of the Prior Art

In space trusses of the kind above referred to, which are mainly used for supporting roofs over large halls, the struts commonly form a pyramidal pattern between the two lattices, which in most cases have at least generally square openings, although other variants may also be found. Further, it is customary that one lattice, e.g. the lower one, is slightly smaller than the other in length as well as in width, and in practice, the smallest span of a space truss of the kind here in question is rarely less than about 20 meters, and the vertical distance between the two lattices is usually at least about 1 meter.

The basic problem in constructing such space trusses is to keep the total costs down. This can be achieved only by using the cheapest possible material—under due consideration of the demands for strength, of course—and by at the same time simplifying and also reducing as far as possible the preparatory adaptation of the material as well as the assembly work at the building site.

The original method of erecting a space truss of the kind here in question, which is still applied to a certain extent, is to join together by welding lengths of suitable bars or tubes which in advance have only been cut to size. However, in this case the welding work becomes very extensive and time-consuming, and it requires great skill and care from the welder to make the joints sufficiently strong and reliable. In addition, a multiplicity of fixtures must be used in order to avoid deformations. As a result, the total cost of the completed space truss will be high, above all because of high labour costs.

The most common alternatives to the method just described are based on the use of fairly complex node elements, frequently in combination with specially designed end portions on all the adjoining bars and struts. Thereby a considerable part of the preparatory work may be carried out in a workshop, i.e. under the most favorable conditions, but at the same time the assembly work at the building site commonly becomes so intricate that the same can only be carried out by specially trained workers. Further, in most cases the manufacture of the node elements themselves and sometimes also the preparation of the bar and strut end portions to be connected thereto require qualified and expensive machining operations. Also, almost without exception, the node elements require the use of tubular bars and struts, which contributes to an increased material cost. Hence, even if the use of such prefabricated node elements may result in a certain saving of time at the building site, the total cost of the completed space truss will still be high.

SUMMARY OF THE INVENTION

The primary aim of the present invention is to provide a space truss of the kind set forth in the introductory paragraph, which may be erected at a considerably lower total cost than a corresponding space truss erected by using any previously known technics thanks to, on one hand, considerable savings as far as the material proper is concerned and, on the other hand, considerable simplifications of the preparatory work in the workshop as well as, and not the least, of the assembly work at the building site.

Basically this aim is achieved according to the invention by avoiding all complex and expensive node elements, by using only low-priced steel sections in the two lattices, and by uniting the latter by means of easy to make struts of inexpensive, special design permitting their installation with simple bolt connections.

For further elucidation of the invention some embodiments thereof will be described in the following and with reference to the accompanying drawings, but it is to be noted that in these examples many modifications of the details may be resorted to without departing from the scope of the invention as defined in the following claims.

DESCRIPTION OF THE PREFERRED EMBODIMENTS

Figure 1:
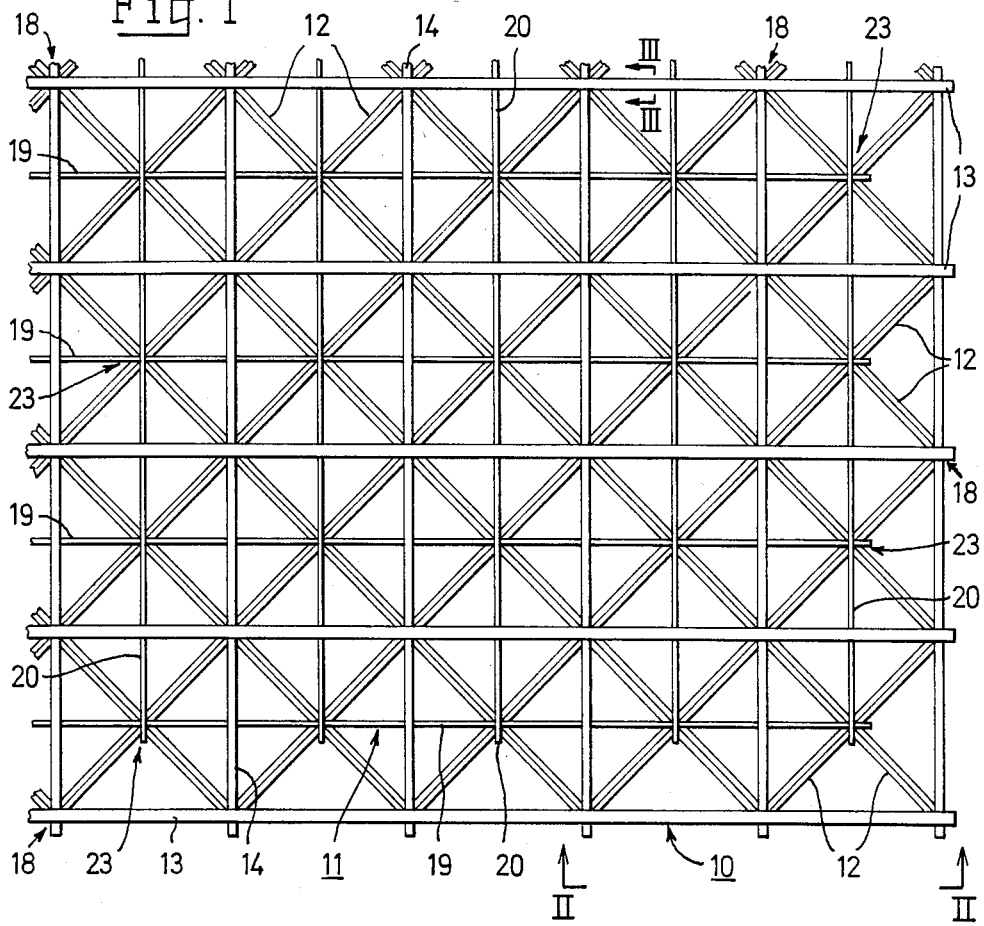
FIG. 1 is a partial plan view of a space truss embodying the invention.
Figure 2:
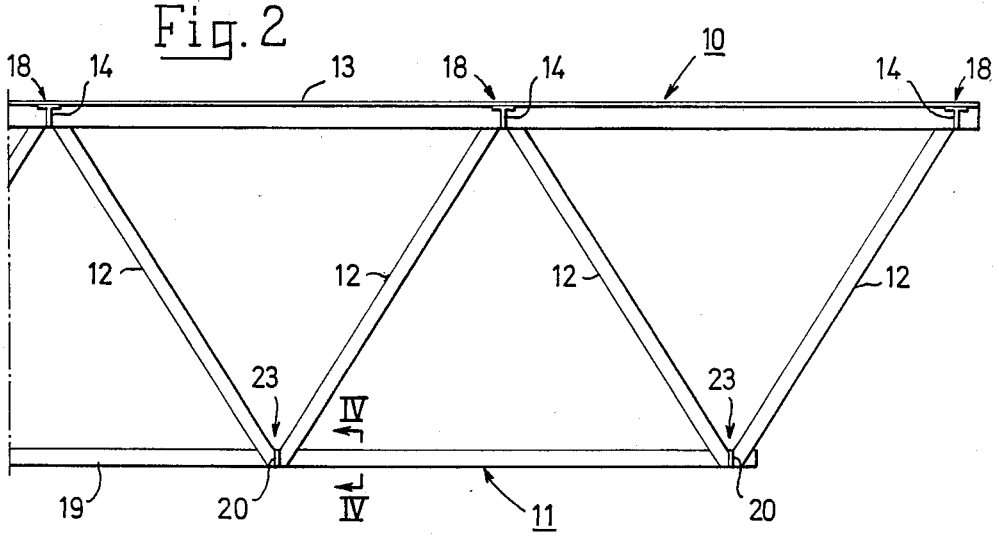
FIG. 2 is a partial side elevational view on an enlarged scale of the same space truss as seen from the line II—II in FIG. 1.

As appears from FIGS. 1 and 2, a space truss embodying the invention comprises an upper horizontal lattice 10, a lower horizontal lattice 11, and a multiplicity of struts 12 which all form oblique angles with the respective planes of the two lattices 10 and 11 and rigidly connect the two lattices to one another in order to maintain between them a predetermined vertical distance. It is to be noted that FIG. 1 shows only a corner portion of the entire space truss which, accordingly, is presumed to have in two directions perpendicular to one another a considerably greater span than appears from the figure. Of course, when seen in plan view, the space truss in its entirety may have any desired shape. In the case shown, the upper lattice 10 is somewhat larger than the lower one 11 in length as well as in width, but the reverse relation is also feasible.

The upper lattice 10 is composed of two groups of steel bars 13 and 14, the bars in each group being parallel to one another, and the two groups of bars intersect at a right angle in order to form generally square openings between them. The bars 13 and 14 in the upper lattice will always be subjected to compression forces and must therefore have a relatively high buckling strength. Hence, according to the invention, they consist of T-bars having downwardly directed webs, as also appears from FIG. 3. In the particular case here illustrated the T-bars 13 have a slightly larger cross sectional dimension than the T-bars 14, and their flanges 13' are placed on top of the flanges 14' of the crossing T-bars 14 in order to thereby serve all by themselves as a bed for a deck, not shown, which by way of example may form part of a roof structure supported by the space truss.

Figure 8:
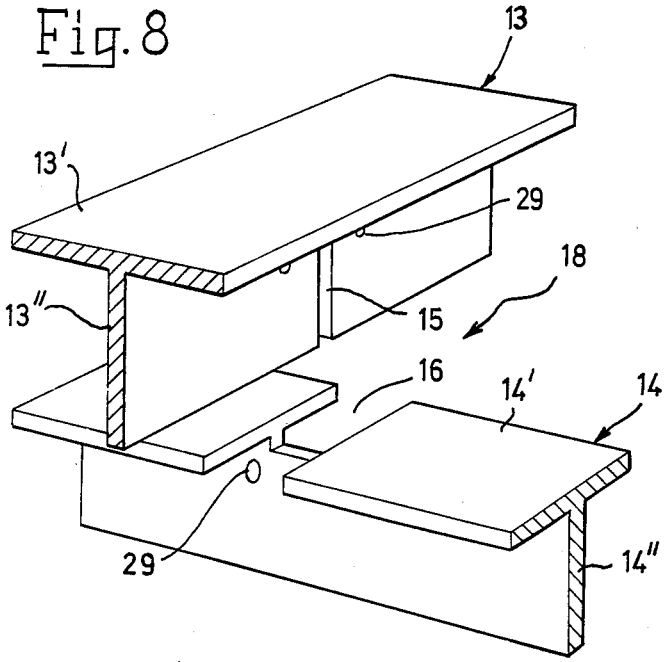
FIG. 8 illustrates schematically the joining together of the bars forming the upper lattice of the space truss shown in FIGS. 1 to 5 inclusive.

The T-bars 13 and 14 extend without interruption over the entire length and width, respectively, of the upper lattice 10. However, each of them may well be composed of several shorter T-bar pieces welded together in end to end relationship, so that dimensional changes, well known per se, may be provided where required. The joining together of the intersecting T-bars 13 and 14 is accomplished, as schematically illustrated in FIG. 8, by providing the downwardly directed web 13" of each T-bar 13 just opposite to each crossing T-bar 14 with a fairly deep, slot-like and downwardly open notch 15 adapted to straddle the web 14" of the T-bar 14, and by locally cutting away the flanges 14' of the latter at 16, so that the T-bar 13 from above may be lowered over the web 14", and the bars thus may be hooked together. Thereafter the two intersecting T-bars 13 and 14 are permanently secured to each other by means of welds, of which some are indicated at 17 in FIG. 3 and some, not being visible, connect the webs of the two T-bars, all for forming a firm node, generally designated by 18—see FIGS. 1, 2, 3 and 5.

Essential to the invention is, in the first place, that the bars of the upper lattice consist of T-bars, because such bars afford a high resistance to buckling at a minimum cost. Further, it is essential that these T-bars produce nodes 18 presenting one or more inner corners formed by the side faces of the webs of the intersecting T-bars, which side faces are at least approximately vertically oriented and converge towards the centre of the node. These inner corners thereby become unobstructed in the downward direction, i.e. towards the lower lattice 11, and they should have a vertical extent corresponding to the major part of the cross sectional height of the T-bars, which in turn, is several times greater than the thickness of the T-bar webs.

The lower lattice 11 is in its turn composed of two groups of bars 19 and 20, respectively, in this case consisting of flat steel bars standing on edge, i.e. having at least approximately vertically oriented broad side faces, and each of which has a considerable cross sectional height in comparison with its thickness. Also these flat bars are parallel in each separate group, and the two groups intersect at right angles in order to form between them square openings having generally the same size as the openings in the upper lattice 10. More specifically, the horizontal center distance between adjacent flat bars 19 is the same as the center distance between adjacent T-bars 13, and the center distance between adjacent flat bars 20 is the same as the center distance between adjacent T-bars 14.

Figure 9:
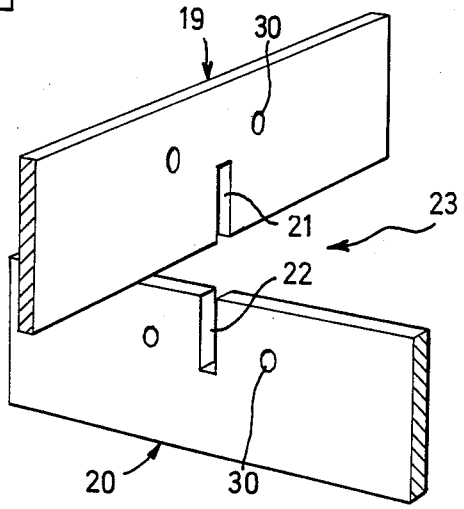
FIG. 9 is a similar illustration of the joining together of the bars forming the lower lattice of the space truss just defined.

As is schematically illustrated in FIG. 9, the two groups of flat bars 19 and 20 are joined together by providing each flat bar 19 belonging to one group with downwardly open, slot-like notches 21 having a width, which is accomodated to the thickness of the crossing flat bars 20, and a depth corresponding to half the height of its cross section, and by further providing each flat bar 20 belonging to the other group with upwardly open, slot-like notches 22 having a width, which is accomodated to the thickness of the flat bars 19, and a depth, which corresponds to half the height of its cross section. Thereby the flat bars 19 and 20 may be simply hooked together in order to become recessed in one another to half their heights at each node 23 in the lower lattice 11.

Figure 4:
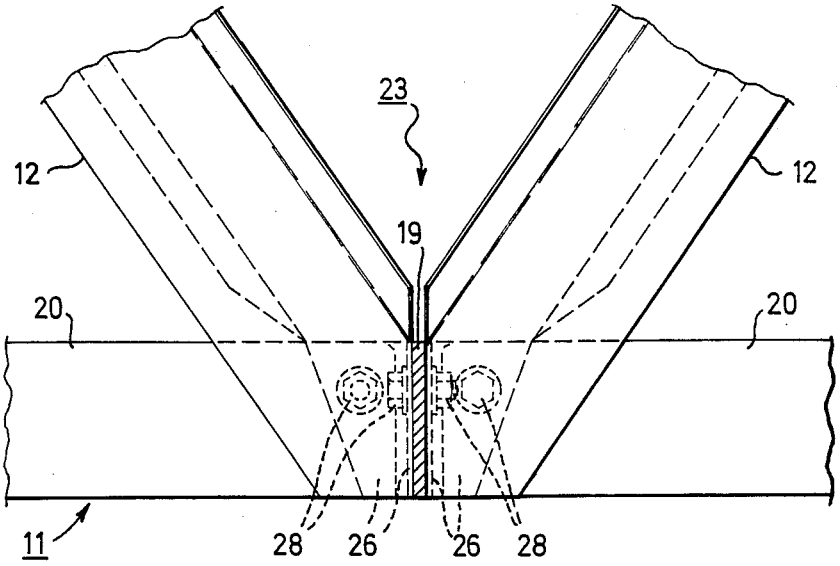
FIG. 4 is a similar fragmentary vertical section taken along the line IV—IV in FIG. 2 and illustrating a node in the lower lattice of the space truss.

Moreover, the flat bars 19 and 20 in each node 23 welded together in order to maintain full strength in spite of the notches 21 and 22. They extend without interruption over the full length and width of the lower lattice 11 but also here each of them may be composed of several shorter flat bar pieces welded together in end to end relationship so as also to present, in a manner well known per se, dimensional changes where required. Of course, the flat bars 19 and 20 do not need to have mutually the same cross sectional dimensions, but it is advantageous if they have one and the same cross sectional height, as shown in FIG. 4.

As far as the lower lattice 11 is concerned it is essential to the invention that each of the nodes 23 presents inner corners formed by converging and at least approximately vertically oriented side faces, namely in this case the broad side faces of the intersecting flat bars 19 and 20 standing on their edges. These inner corners will then generally correspond to the previously described inner corners of the nodes 18 in the upper lattice 10 but will, of course, be unobstructed in both the upward and downward direction.

As best appears from FIG. 1, the chessboard pattern formed by the flat bars 19 and 20 of the lower lattice is displaced horizontally and diagonally in relation to the chessboard pattern formed by the T-bars 13 and 14 of the upper lattice 10, and this in such manner that the nodes 23 of the lower lattice 11 in plan view as in FIG. 1 will be located in the middle of the openings of the upper lattice 10 but, of course, on a considerably lower level. From each node 23 in the lower lattice 11 four struts 12 extend obliquely upwards to related ones of the most adjacent nodes 18 in the upper lattice 10 in a kind of inverted pyramidal pattern, each strut 12 forming an oblique angle, suitably between 30° and 60°, with the planes of the two lattices. All the struts 12 have the same length and design and are in this case made of bent sheet metal, the thickness of which is considerably less than the thickness of the webs 14" of the T-bars 14 as well as of the flat bars 19 and 20, which permits a considerable saving of material.

Figure 6:
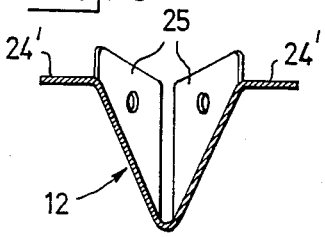
FIG. 6 is a cross section taken along the line VI—VI in FIG. 3 and showing only the strut proper.
Figure 7:
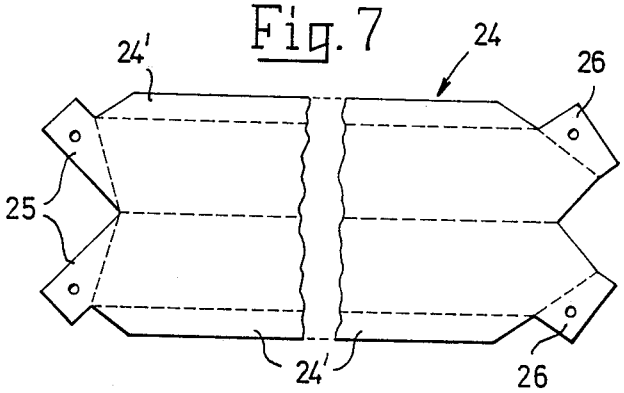
FIG. 7 shows on a reduced scale a shortened development of the strut of FIG. 6.

A sheet metal blank 24 for such a strut 12 is shown in a spread-out but shortened condition in FIG. 7. This blank 24 is to be bent along a longitudinally extending center line to form a V-shaped trough having an angle between its side walls in the order of 40°–70°, and, in addition, longitudinally extending marginal flange portions 24' are bent outwards (FIG. 6) in order to increase the buckling strength of the trough. However, in certin cases where the compression forces occurring in the strut are moderate, these bent out marginal flange portions 24' may be dispensed with. At its one end the sheet metal blank 24 has a pair of holed end tabs 25 which, according to FIG. 6, are bent inwardly towards each other in such manner that their planes will form approximately a right angle with each other (FIG. 5) and extend obliquely to the longitudinal axis of the strut. Also at its other end the sheet metal blank 24 is formed with a pair of holed tabs or ears 26 which are bent inwardly towards each other in a corresponding manner so that their planes will form a right angle with each other and extend obliquely to the longitudinal axis of the strut. The bending takes place along lines indicated in FIG. 7 and in such manner that one end portion of the completed strut 12 will enter and fit into the related inner node corner between the web side faces of the T-bars 13 and 14 of the upper lattice 10, whereas the other end portion of the strut at the same time will enter and fit into the related inner node corner between the vertical side faces of the flat bars 19 and 20 of the lower lattice 11.

Figure 3:
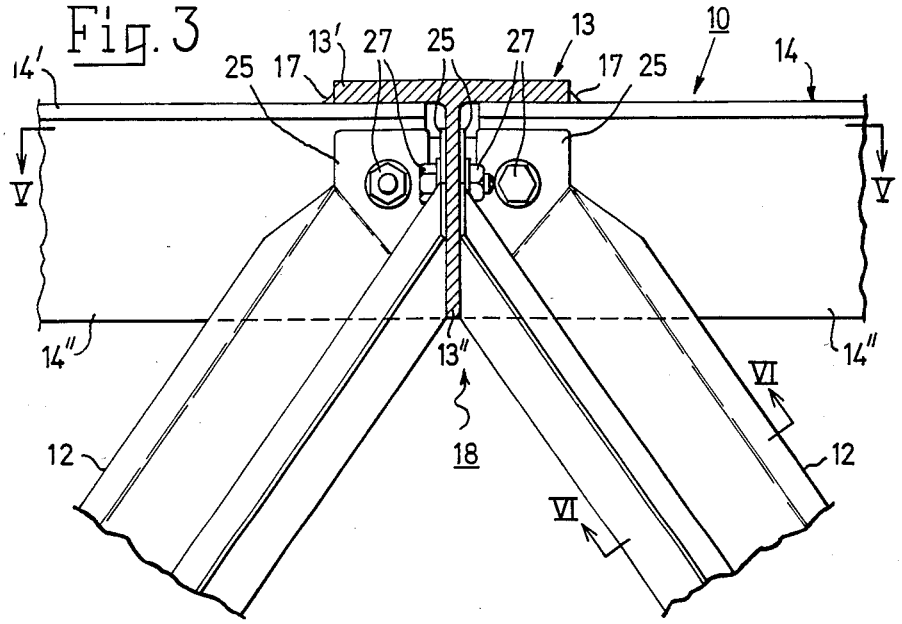
FIG. 3 is a further enlarged fragmentary vertical section taken along the line III—III in FIG. 1 and illustrating a node in the upper lattice of the space truss.
Figure 5:
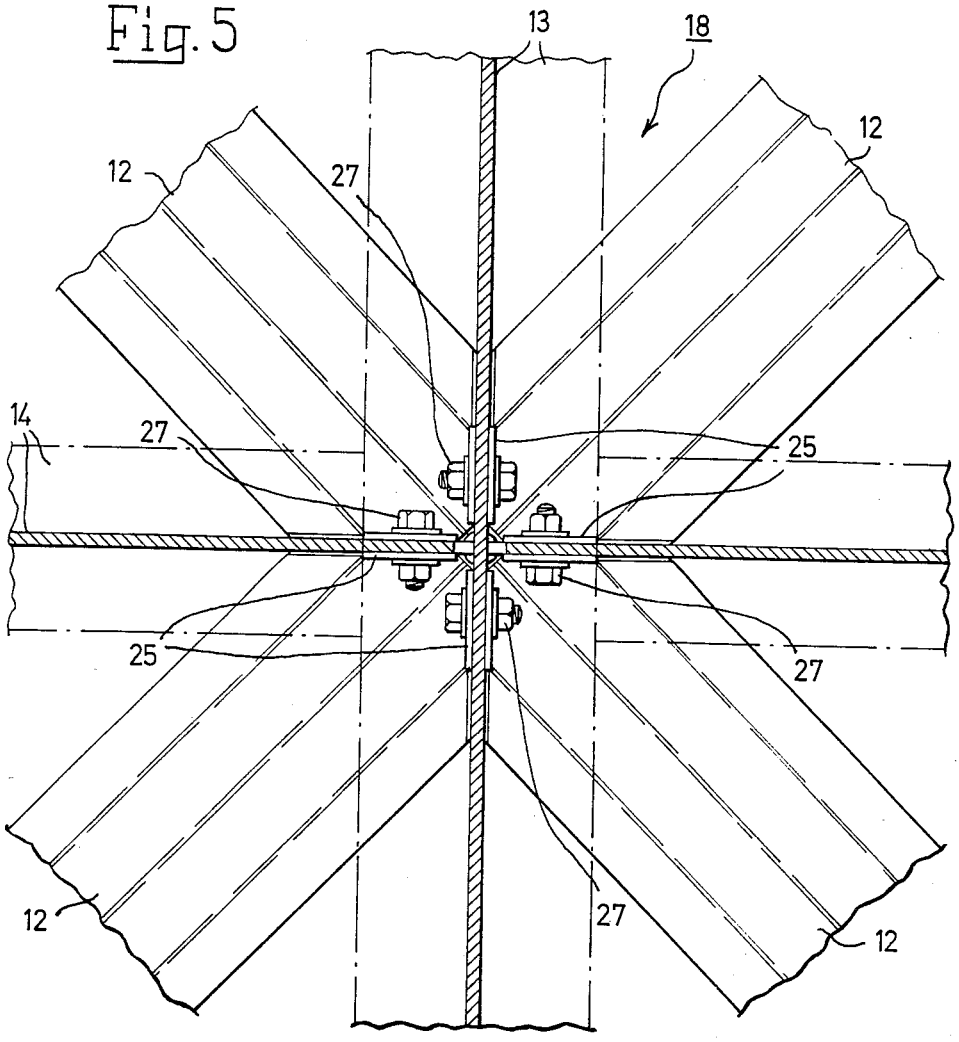
FIG. 5 is a horizontal section taken along the line V—V in FIG. 3.

In each node 18 of the upper lattice 10 the upper end portion of each strut 12 is secured by means of two bolt-and-nut connections 27 in such manner that the one end tab 25 will come to lie in surface contact with and be clamped against the web 13'' of the T-bar 13, whereas the other end tab 25 will come to lie in surface contact with and be clamped against the web 14'' of the T-bar 14, as appears from FIGS. 3 and 5. In each node 23 of the lower lattice 11 the lower end portion of each strut 12 is likewise secured by means of two bolt-and-nut connections 28 in such manner that one ear 26 will come to lie in surface contact with and be clamped against the side face of the flat bar 19, whereas the other ear 26 will come to lie in surface contact with and be clamped against the side face of the flat bar 20, as appears from FIG. 4. Each bolt-and-nut connection 27 and 28, respectively, is used, where possible, for attaching two struts 12, as can be best seen in FIG. 5, and, of course, after having been tightened the bolt-and-nut connections are locked in any arbitrary known manner.

Instead of bending the tabs 25 and the ears 26 of the struts 12 inwardly as above described and shown, one may, of course, also bend them outwardly, if so desired, in order to possibly make it easier to put the bolt-and-nut connections 27 and 28, respectively, in place and to tighten them. In such a case each tab and/or ear may also be given another shape than the one shown. Similarly, if so desired, the struts 12 may be inverted so that their lower end portions in the example shown are connected to the upper lattice 10, and vice versa.

In order to make it possible to put the bolt-and-nut connections 27 and 28 in place, the webs 13'', 14'' of the T-bars 13, 14 as well as the flat bars 19, 20 must, of course, be provided with holes 29 and 30, respectively, for the bolts, as indicated in FIGS. 8 and 9. These holes are made in advance, for example in connection with providing the T-bars and flat bars with their notches shown in the figures just mentioned, and the diameters of these holes 29 and 30 should be chosen sufficiently large to allow for certain tolerances. This means that, when its related bolt-and-nut connections 27, 28 are tightened, each strut will be locked mainly by friction against the vertical web side faces of the T-bars and against the vertical broad side faces of the flat bars, respectively.

To the invention it is essential that the respective end portions of the struts 12 are formed for being brought into surface contact with an area portion on each of the two vertical bar side faces which converge towards an inner corner of the respective node 18, 23, and that the attachment of each strut end portion is effected by means of at least two separate bolt connections, one on each side of the inner corner. Owing to this the joining together of the space truss is considerably simplified from several points of view, and at the same time a satisfactory strength of each node can easily be assured. In addition, the described strut 12 is very material-saving and simple to make.

In the variant of the s ace truss embodying the invention, of which only certain details are shown in FIGS. 10 to 13 inclusive, the completed truss may be assumed to have generally the same construction as the one shown in FIGS. 1 and 2, i.e. it comprises an upper lattice 10' and a lower lattice 11' which are interconnected by a plurality of oblique and diagonally extending struts 12'. The differences are mainly to be found in the design of the lower lattice 11' as well as the struts 12', whereas the upper lattice 10' in the same way as the lattice 10 is composed of two intersecting groups of mutually parallel T-bars 113, 114 having downwardly extending webs 113'' and 114'', respectively.

Figure 11:
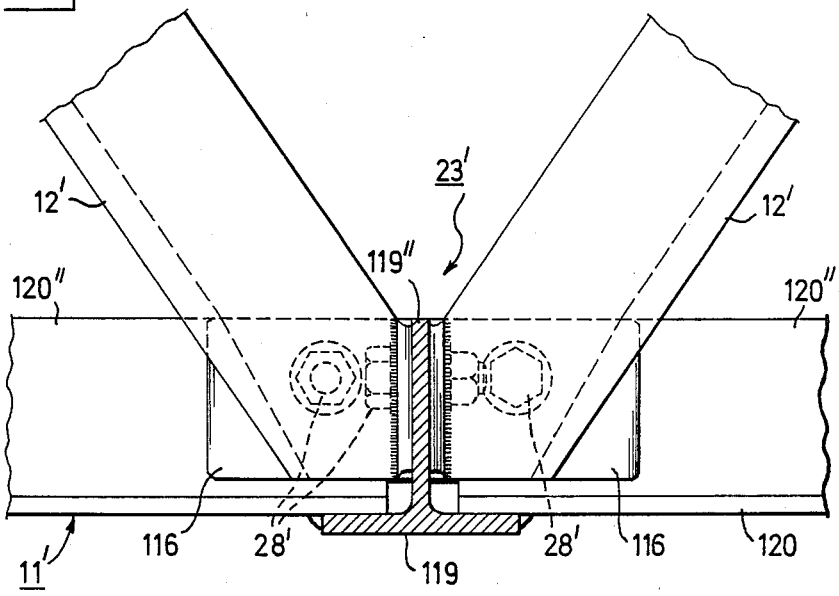
FIG. 11 is a fragmentary vertical section similar to FIG. 4 but showing a node in the lower lattice of the modified space truss.
Figure 13:
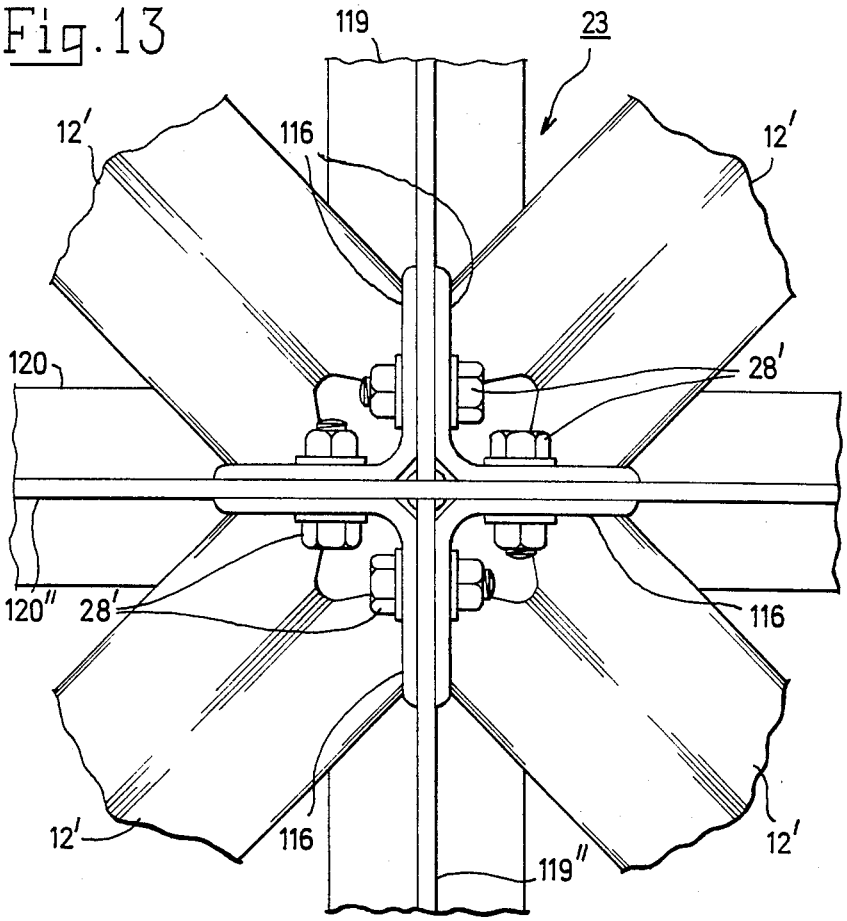
FIG. 13 is a horizontal sectional view showing the lower lattice node as seen from above in FIG. 11.
Figure 12:
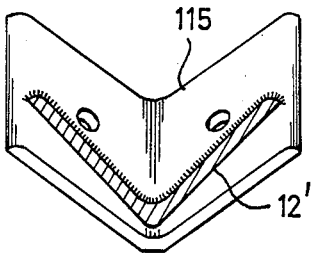
FIG. 12 is a cross section taken along the line XII—XII in FIG. 10 and showing the modified strut only.

The modified lower lattice 11' is, like the upper lattice 10', composed of two intersecting groups of mutually parallel T-bars 119, 120 which, however, have their webs 119'' and 120'', respectively, extending upwardly (FIGS. 11 and 13). The joining together of these T-bars is suitably carried out in substantially the same manner as the joining together of the T-bars 113 and 114 of the upper lattice 10', and thus in accordance with the schematical illustration of FIG. 8. It should be readily understood that, in case of need, the modified lower lattice 11' of T-bars may replace the lattice 11 of flat bars shown in FIGS. 1, 2 and 4, like the lastmentioned one may replace the lattice 11' shown in FIGS. 11 and 13, namely if the lower lattice of the modified space truss will only be subjected to negligible compression stains.

Figure 10:
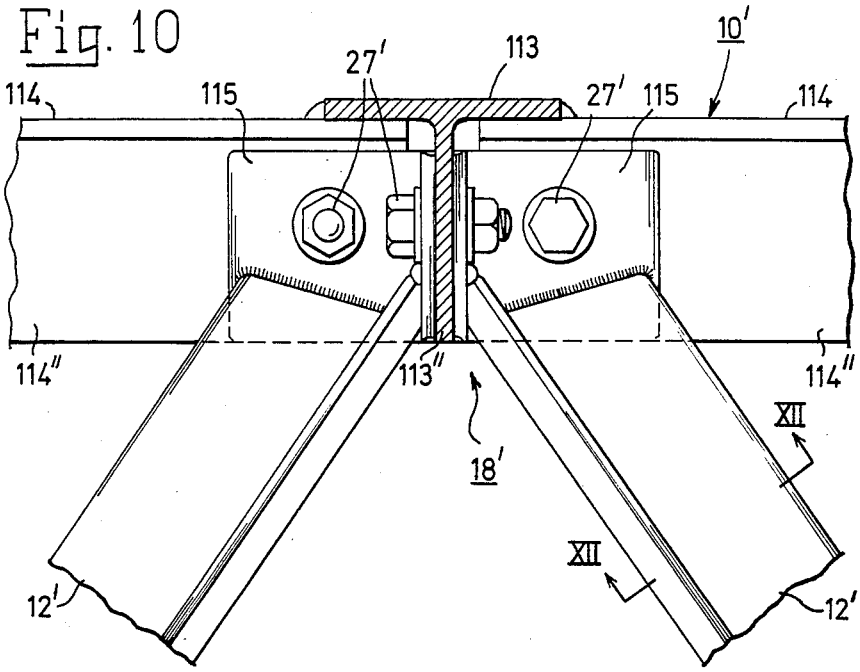
FIG. 10 is a fragmentary vertical section similar to FIG. 3 but showing a node in the upper lattice of a slightly modified space truss embodying the invention.

The struts 12' differ more considerably from the struts 12 in the preceding example in that they are made of adapted lengths of conventional, equal-sided angle bars with right-angled cross section, which at their respective ends have been provided with angular end fittings 115 and 116, respectively, the latter being each by means of two bolt-and-nut connections 27' and 28', respectively, secured in the inner corners of the nodes 18' and 23', respectively, as illustrated in FIGS. 10, 11 and 13. The angular end fittings 115 and 116, which are provided with holes for the bolts, are in a workshop welded to the ends of the struts 12' by using suitable fixtures, so that the modified struts at the building site, similarly to the sheet metal struts 12 previously described, are ready for immediate installation and locking by means of the bolt connections provided.

The erection of the space truss at the building site—irrespective of which one of the two variants is chosen—preferably takes place in such manner that first the lower lattice 11 or 11' is assembled on suitable, provisional and accurately levelled supports. Thereafter at least some of the struts 12 or 12' are attached with their lower ends by means of the bolt-and-nut connections 28 and 28' to the nodes 23 or 23' of the lower lattice without, however, the nuts on the bolts being fully tightened. In the next step the T-bars 14 or 114 belonging to the upper lattice 10 or 10' are attached to the upper ends of the installed struts by means of their related bolt-and-nut connections 27 or 27', whereupon the T-bars 13 or 113 are installed and welded to the bars 14 or 114 where required. In the next following step the struts 12 or 12' still missing and the remaining bolt-and-nut connections are put in place. Finally, all the bolt-and-nut connections are carefully tightened and locked after possibly required positional adjustment of all the components of the space truss has taken place. Any required welding of the nodes of the lower lattice should suitably be accomplished before any one of the struts 12 or 12' is installed.

It is to be noted that the interengaging notches or incuts in the intersecting bars, such as the notches 15 in FIG. 8 and the notches 21, 22 in FIG. 9, are made in advance, e.g. in a workshop, at carefully preselected intervals along the respective bars and thus make the proper interconnection of the intersecting bars in each lattice very convenient when the space truss is to be assembled at the building site.

It should be readily understood that the end portions of the struts 12 or 12' in case of need may be secured to the respective nodes in the upper as well as in the lower lattice by means of more than two separate bolt-and-nut connections, e.g. by two such connections on each side of the inner corner of the node giving a total of four connections for each strut end. Likewise it should be understood that the end fittings 115 and 116 of the struts 12' may be made so robust that, especially if they are each secured by more than two bolt connections, they are capable of holding together the bars in one or both of the lattices in such a reliable manner that a welding together of said bars becomes superfluous.

I claim:

1. A metal space truss of the kind comprising two at least generally horizontally extending and vertically spaced lattices, an upper one and a lower one, both of which are composed of two intersecting groups of parallel bars which in the respective lattices are joined to each other in a plurality of nodes, and a plurality of struts, each of which forms an oblique angle with the planes of the two lattices and connects a related node in said upper lattice to another related node in said lower lattice, wherein:

(A) said intersecting bars of said upper lattice consist of T-bars having downwardly directed webs with opposite generally vertically oriented side faces, (a) said T-bars being joined together where intersecting to form first nodes in each of which said generally vertically oriented web side faces of said T-bars converge in a manner to define between them at least one first inner corner which is unobstructed in a downward direction;

(B) said intersecting bars of said lower lattice have such cross sectional configurations that each of them presents opposite generally vertically oriented lateral face portions, (b) said bars of said lower lattice being joined together where intersecting to form second nodes in each of which said generally vertically oriented lateral face portions of said lower lattice bars converge in a manner to define between them at least one second inner corner which is unobstructed in an upward direction;

and wherein (C) each of said struts has an upper end portion entering obliquely from below a first inner corner of a related first node in said upper lattice and presenting oblique surface portions adapted for making surface contact with one vertically oriented web side face on each of the two T-bars intersecting in said related first node, (c) said upper strut end portion being secured by at least one bolt connection directly to each of the two webs of said two intersecting T-bars so as to also form all by itself between said T-bars a node-stabilizing connector; and (D) each of said struts has a lower end portion entering obliquely from above a second inner corner of a related second node in said lower lattice and presenting oblique surface portions adapted for making surface contact with one vertically oriented lateral face portion on each of the two lower lattice bars intersecting in said related second node, (d) said lower strut end portion being secured by at least one bolt connection directly to each of said two intersecting lower lattice bars so as to also form all by itself between said lower lattice bars a node-stabilizing connector.

2. A metal space truss according to claim 1, wherein said upper lattice bars and said lower lattice bars in the respective one of the two lattices intersect at a generally right angle to form said first and second nodes respectively, and are hooked together by means of cooperating notches.

3. A metal space truss according to claim 1, wherein said intersecting bars of said lower lattice consist of flat bars standing on edge.

4. A metal space truss according to claim 1, wherein said intersecting bars of said lower lattice consist of T-bars having upwardly directed webs.

5. A metal space truss according to claim 1, wherein said struts have a generally V-shaped cross section.

6. A metal space truss according to claim 5, wherein said struts are made of elongate sheet metal blanks which have been bent to form troughs of generally V-shaped cross section, and wherein said struts at each end present a pair of bent ears forming said upper and lower strut end portions with oblique surface portions adapted for making surface contact with said bars intersecting in the respective first and second nodes, each of said ears being provided with at least one hole for the bolt of a corresponding bolt connection.

7. A metal space truss according to claim 6, wherein said trough-like struts have side walls forming between them an angle of from about 40° to about 70°, said side walls having longitudinally extending marginal portions bent outwards therefrom for increasing the buckling strength of the strut.

8. A metal space truss according to claim 5, wherein said struts consist of adapted lengths of equal-sided angle bars with right-angled cross sections being at their respective ends provided with welded-on angular fittings formed said oblique surface portions adapted for making surface contact with said bars intersecting in the respective first and second nodes, said fittings having holes for the bolts of said bolt connections.

9. A metal space truss according to claim 1, wherein each of said bolt connections in most of said first and second nodes secures two adjacent strut end portions to one and the same lattice bar extending between and separating said adjacent strut end portions from one another.

* * * * *